US008209850B2

(12) United States Patent
Bender

(10) Patent No.: US 8,209,850 B2
(45) Date of Patent: Jul. 3, 2012

(54) METHOD FOR MANUFACTURING PENCIL CORES

(75) Inventor: Mark Bender, Algonquin, IL (US)

(73) Assignee: Tempel Steel Company, Chicago, IL (US)

( * ) Notice: Subject to any disclaimer, the term of this patent is extended or adjusted under 35 U.S.C. 154(b) by 0 days.

(21) Appl. No.: 12/731,684

(22) Filed: Mar. 25, 2010

(65) Prior Publication Data

US 2011/0234361 A1 Sep. 29, 2011

(51) Int. Cl.
*H01F 7/06* (2006.01)

(52) U.S. Cl. ..... 29/606; 29/605; 336/176; 336/200; 336/212; 336/229; 336/234

(58) Field of Classification Search ..... 29/592.1, 29/602.1, 605, 606; 336/176, 200, 212, 229, 336/234; 310/156
See application file for complete search history.

(56) References Cited

U.S. PATENT DOCUMENTS

| | | | | |
|---|---|---|---|---|
| 3,875,660 | A * | 4/1975 | Kobayashi et al. | 29/609 |
| 4,413,406 | A * | 11/1983 | Bennett et al. | 29/609 |
| 4,848,684 | A * | 7/1989 | Sasaki et al. | 336/212 |
| 5,037,706 | A | 8/1991 | Lin et al. | |
| 5,906,040 | A * | 5/1999 | Kawano et al. | 29/738 |
| 5,986,532 | A | 11/1999 | Kikuta et al. | |
| 6,025,770 | A | 2/2000 | Okamoto et al. | |
| 6,092,278 | A | 7/2000 | Latkow | |
| 6,363,599 | B1 * | 4/2002 | Bajorek | 29/424 |
| 6,501,365 | B1 | 12/2002 | Elliott et al. | |
| 6,744,342 | B2 | 6/2004 | Dechristofaro et al. | |
| 2008/0042505 | A1 * | 2/2008 | Gerster et al. | 310/152 |

FOREIGN PATENT DOCUMENTS

| | | | |
|---|---|---|---|
| DE | 20318993 | U1 * | 4/2004 |
| JP | 55160318 | A * | 12/1980 |
| JP | 9007860 | A | 1/1997 |
| JP | 2002170727 | A | 6/2002 |
| WO | WO 9916092 | A1 * | 4/1999 |

OTHER PUBLICATIONS

Altana Coatings Sealants Remisol EB 548 Printed Aug. 30, 2004.
DuPont™ Voltatex® 1175W technical Data Sheet—2008.
Beacon Adhesives Co. Inc.—Admitted Prior Art Magna-TAC E645, Stack Lamination Epoxy, 1996.

* cited by examiner

*Primary Examiner* — Paul D Kim
(74) *Attorney, Agent, or Firm* — Schiff Hardin LLP

(57) ABSTRACT

In a method for manufacturing pencil cores a continuous strip of electrical steel is provided. The continuous strip is cut to create a plurality of starting strips as laminations each having a length longer than a desired length of the pencil cores and at least one of the strips having a strip width at least equal to or larger than a desired diameter of a cross-section of the pencil cores. The starting strips are provided with a bonding layer. The starting strips are stacked and then heated and cured to create a bonded stack. The bonded stack is machined to a substantially circular cross-section. Without a de-burring or de-smearing operation after the machining, the machined bonded stack is cut to create a plurality of pencil cores of the desired length. The pencil cores created by the method are substantially round, and have no welds at end faces.

26 Claims, 6 Drawing Sheets

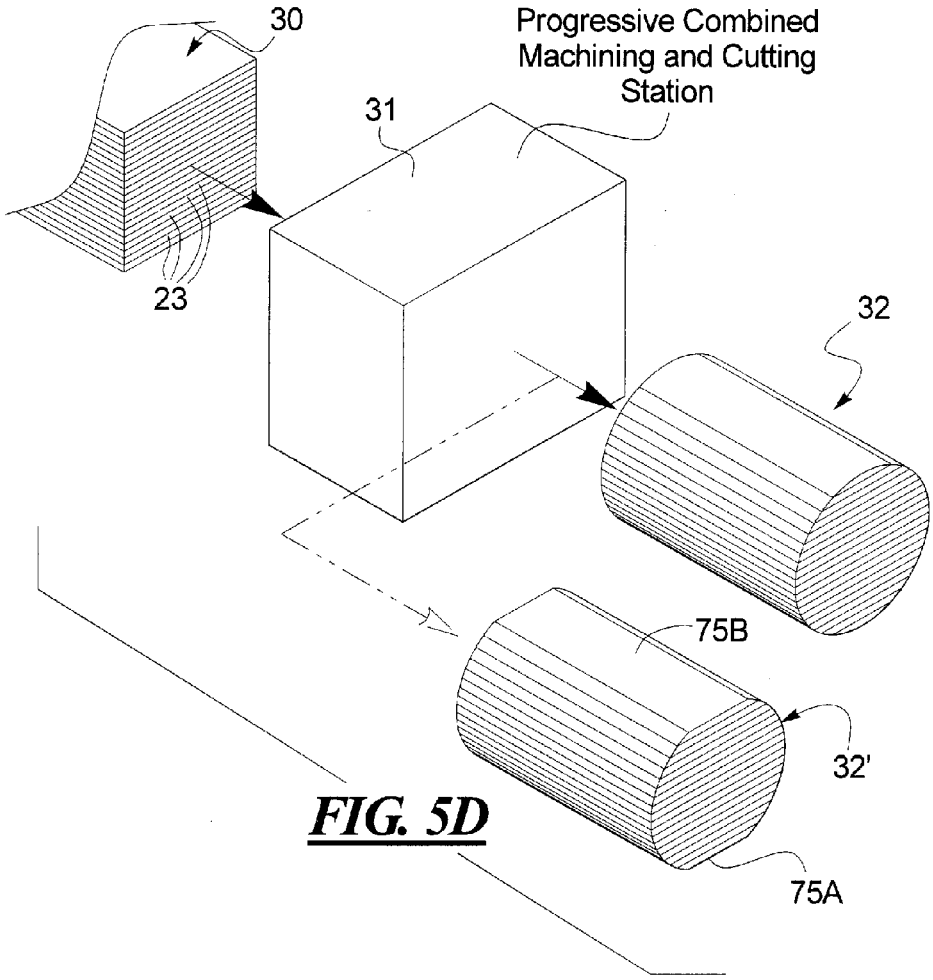
FIG. 5D
FIG. 5D'
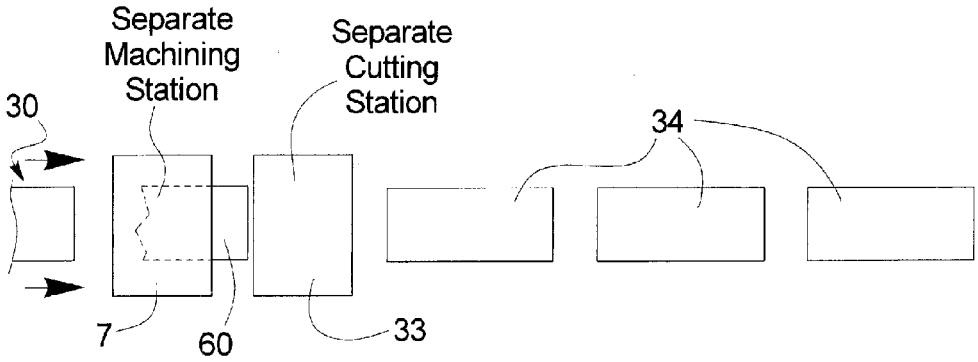

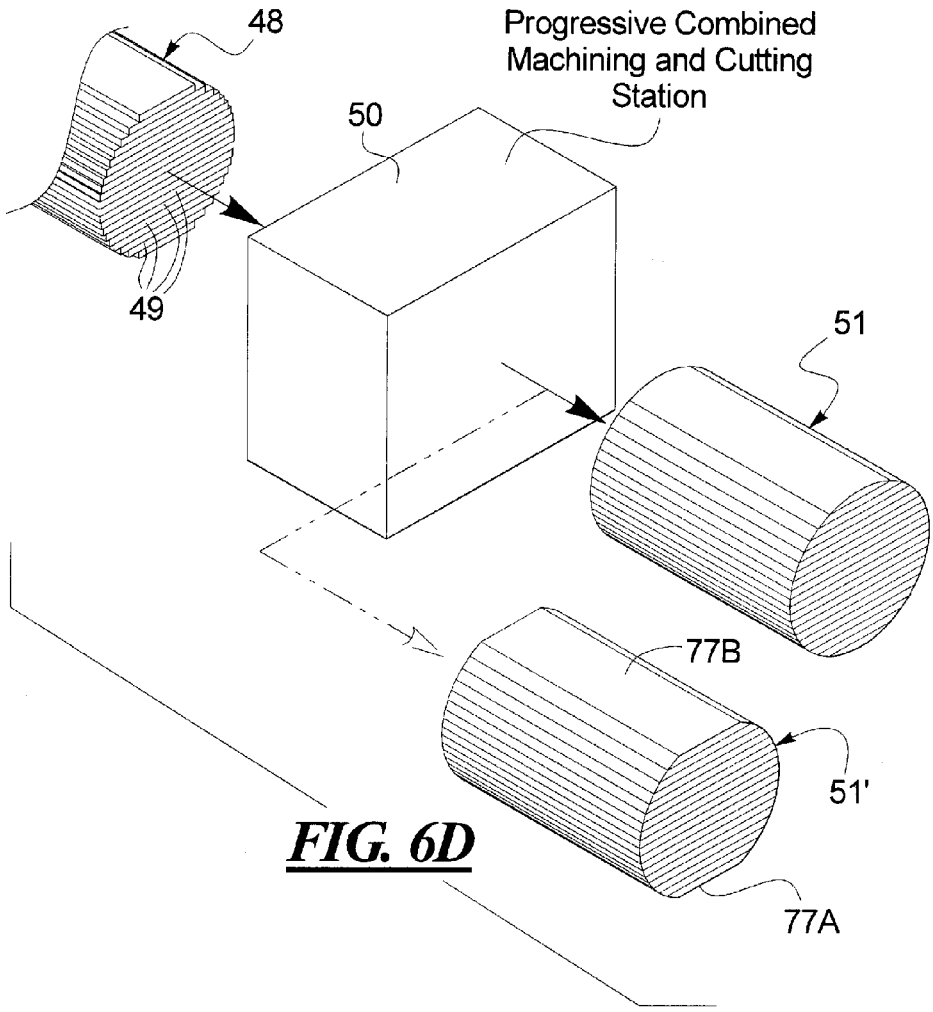
FIG. 6D
FIG. 6D'
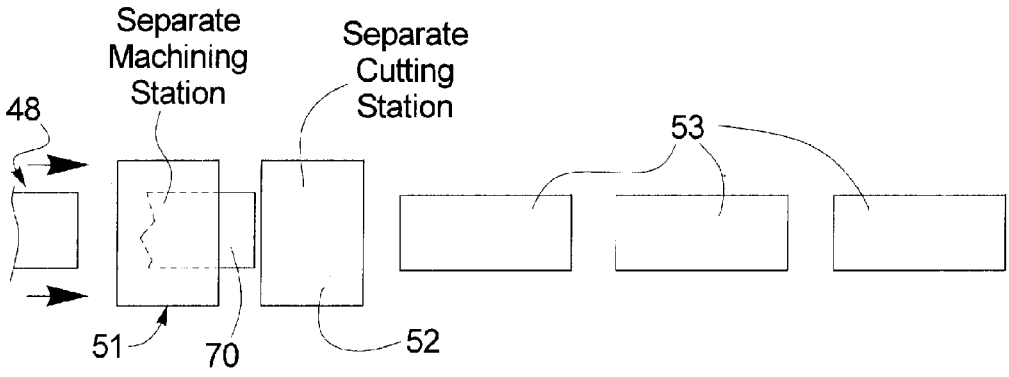

METHOD FOR MANUFACTURING PENCIL CORES

BACKGROUND

It is known from U.S. Pat. No. 6,092,278 to provide ignition voltage for a spark plug in an internal combustion engine by use of a high voltage step-up transformer mounted directly above the spark plug. The high voltage transformer utilizes a magnetic core having a pencil-shape, and thus has become commonly known as a "pencil core".

Such a pencil core is shown at 10 in prior art FIG. 1 from the '278 patent and is formed of a plurality of stacked thin magnetic metal laminations 11 of varying width, but having a substantially constant thickness and a same length so that a substantially circular profile as shown in prior art FIG. 2 results.

In order to maintain the stack as a unified body, it is known in the '278 patent to provide a plurality of embossments 12A, 12B, 12C in the laminations 11 so that the embossment of an upper lamination fits into the inside of an embossment of the following lamination and so on until the last lamination at the bottom. This is most clearly shown in FIG. 2 which is a cross-section taken along line II-II in FIG. 1.

It is also known as shown in FIG. 1 to provide vertical rectangular channels 8 and 9 at end faces of the pencil core where the channels are formed from individual cutouts in each of the laminations. These channels 8 and 9 are used to keep the core vertically aligned as it proceeds through a die.

There are a number of disadvantages to such a pencil core. First, the steps 13 shown in FIG. 2, the embossments 12A, B, C, and the cutouts to form channels 8 and 9 result in a decreased electrical performance of the core. Also not as much electrical steel is provided for a given core diameter because of the steps 13.

It is known from U.S. Pat. No. 6,501,365 to provide a substantially circular pencil core 14 as shown in prior art FIG. 3. According to the '365 patent, such a circular pencil core is manufactured with the following steps.

First, the individual laminations 16 of a constant length corresponding to the length of the desired finished pencil core are cut but with varying width (such as by blanking in a stamping die). Thereafter the laminations 16 are stacked to form a stacked assembly which is clamped and subjected to a mechanical machining so that the stepped dotted portions 15 of the laminations 16 are removed. However, this mechanical machining produces burrs on the lateral portions of the laminations at the lateral edges and these burrs provide undesired electrical conductive paths between laminations which may produce electrical shorts. The mechanical machining also produces undesired smears which may also create electrical shorts.

It is thus necessary to remove the burrs and the smears, such as by electro-chemical etching, for example. The burrs and smears are indicated at 18 in FIG. 3.

Thereafter, as shown in prior art FIG. 4, the end faces 19 and 20 of the machined and de-burred/de-smeared core stack 14 are welded to form the finished pencil core.

The above manufacturing procedure has a number of disadvantages. The welds at the ends decrease the electrical performance of the core. Furthermore, the process is complicated and requires the electro-chemical etching removal of the burrs and smearing. Furthermore, during the machining process, the loose laminations of the stack must be clamped together during the machining process prior to the welding.

SUMMARY

It is an object to provide an improved pencil core with improved electrical performance and method for manufacturing the improved pencil core.

In a method for manufacturing pencil cores a continuous strip of electrical steel is provided. The continuous strip is cut to create a plurality of starting strips as laminations each having a length longer than a desired length of the pencil cores and at least one of the strips having a strip width at least equal to or larger than a desired diameter of a cross-section of the pencil cores. The starting strips are provided with a bonding layer. The starting strips are stacked and then heated and cured to create a bonded stack. The bonded stack is machined to a substantially circular cross-section. Without a de-burring or de-smearing operation after the machining, the machined bonded stack is cut to create a plurality of pencil cores of the desired length. The pencil cores created by the method are substantially round, and have no welds at end faces.

BRIEF DESCRIPTION OF THE DRAWINGS

FIGS. 5A-5D' show a preferred embodiment of an improved manufacturing method to create a substantially circular pencil core of improved electrical performance; and FIGS. 6A-6D' show an alternative embodiment of an improved method for manufacturing to create a substantially circular pencil core of improved electrical performance.

DESCRIPTION OF PREFERRED EMBODIMENTS

Figure 1:
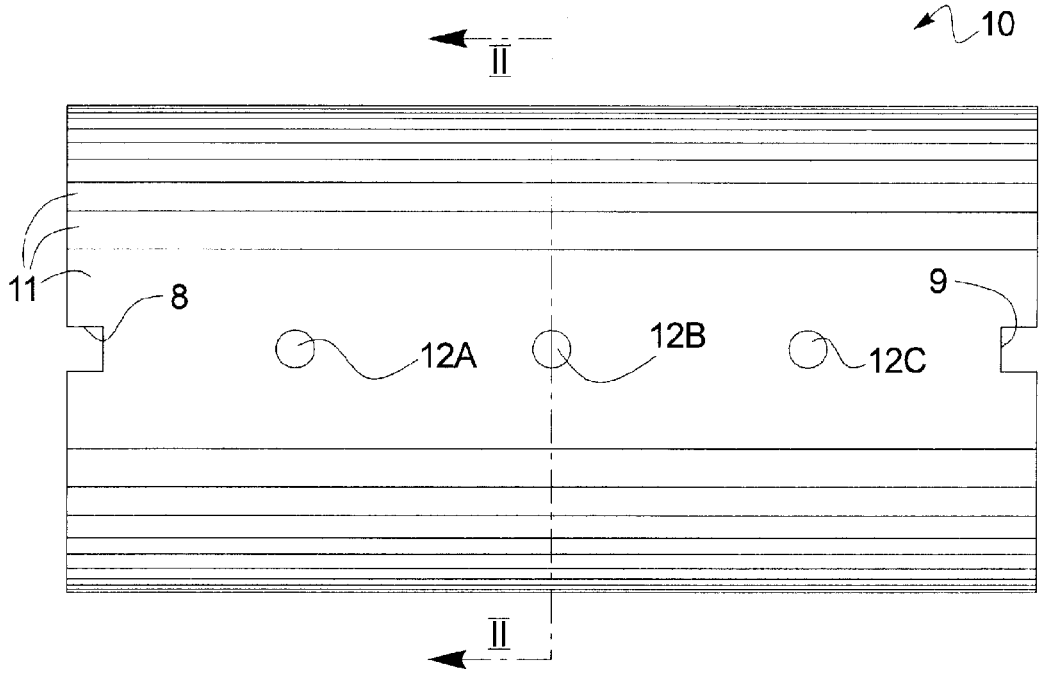
FIG. 1 (PRIOR ART)
FIG. 1 is a top plan view of a prior art pencil core.
Figure 2:
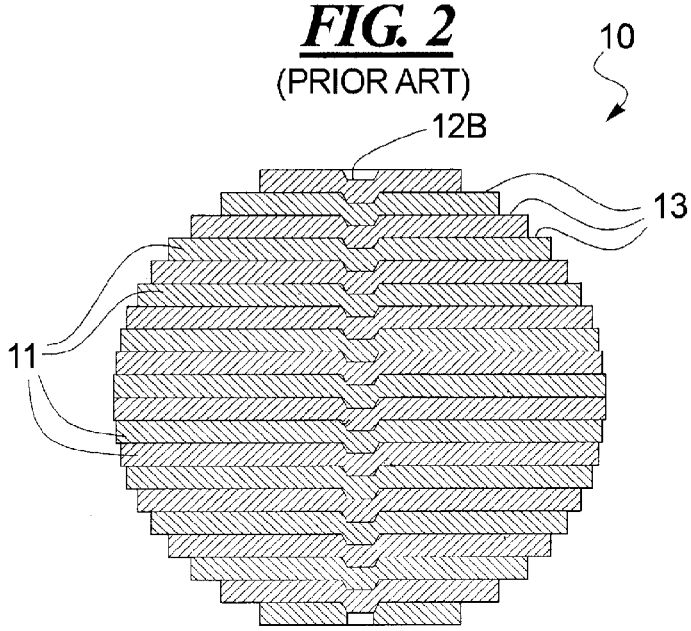
FIG. 2 (PRIOR ART)
FIG. 2 is a cross-sectional view taken along line II-II of prior art FIG. 1 showing steps at an outer periphery or circumference of the pencil core of FIG. 1 and illustrating how the laminations are held together by embossments.
Figure 3:
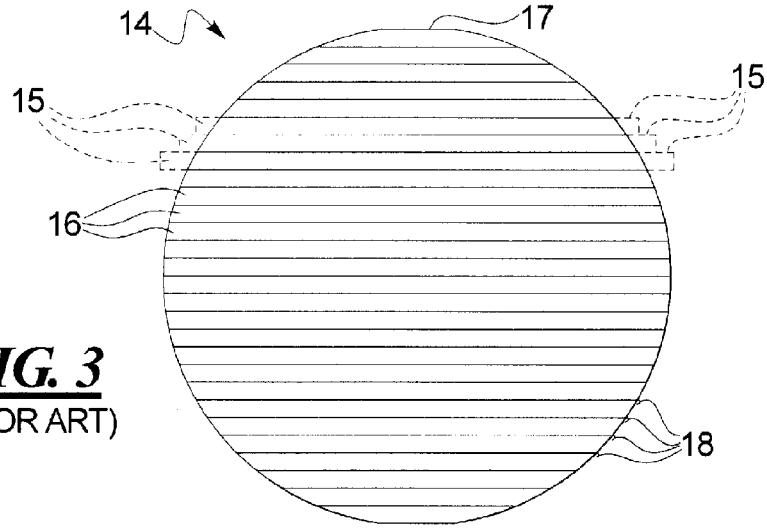
FIG. 3 (PRIOR ART)
FIG. 3 shows a cross-section of a prior art substantially circular pencil core of prior art FIG. 4 taken along cross-sectional line III-III.
Figure 4:
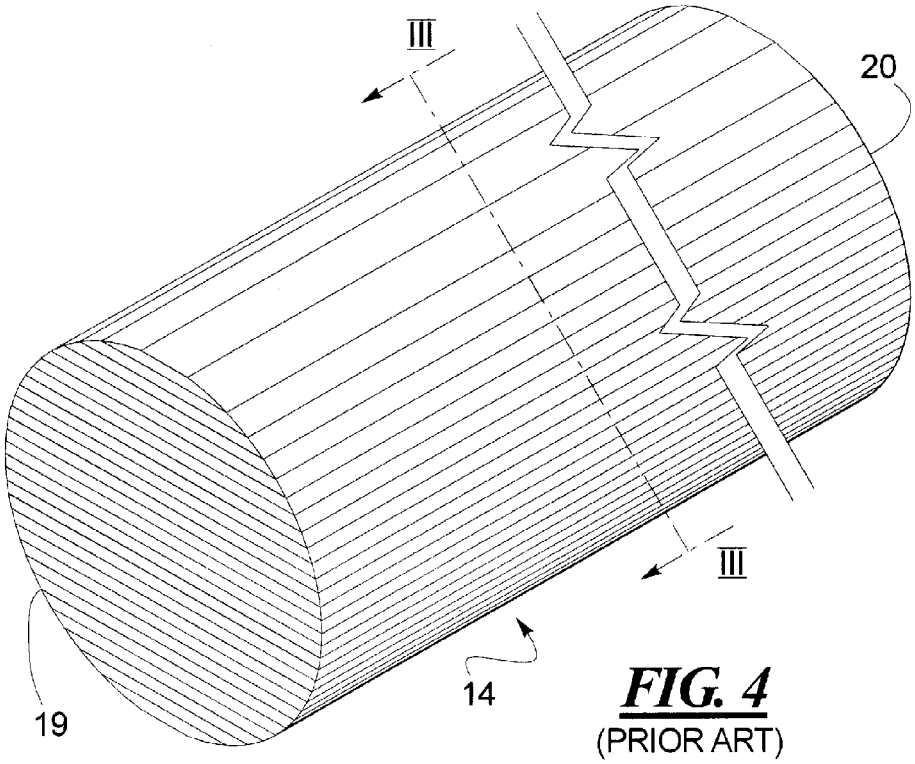
FIG. 4 (PRIOR ART)
FIG. 4 shows in perspective the substantially circular prior art pencil core of FIG. 3.

For the purposes of promoting an understanding of the principles of the invention, reference will now be made to the preferred embodiments/best mode illustrated in the drawings and specific language will be used to describe the same. It will nevertheless be understood that no limitation of the scope of the invention is thereby intended, and such alterations and further modifications in the illustrated device and such further applications of the principles of the invention as illustrated as would normally occur to one skilled in the art to which the invention relates are included.

Figure 5A:
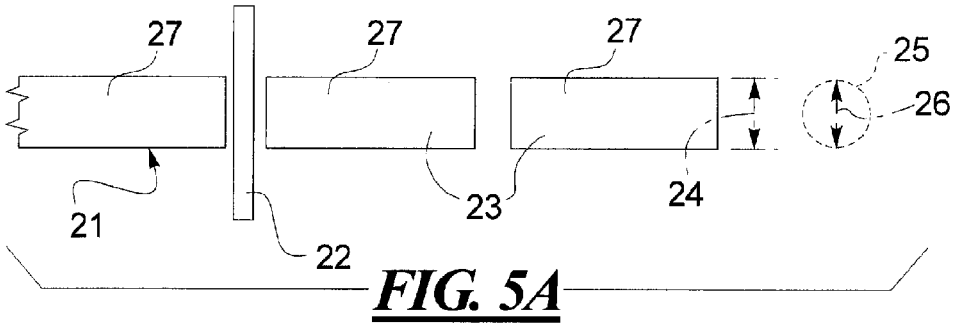
Figure 5B:
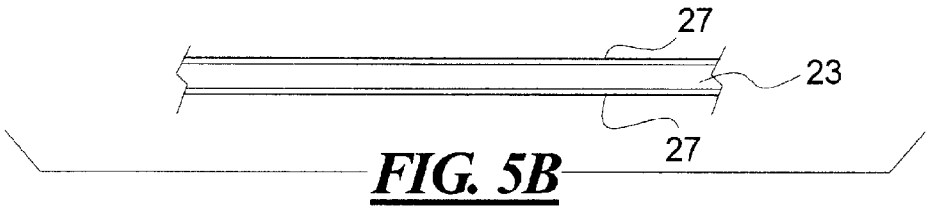

FIGS. 5A-5D' show the improved manufacturing method for manufacturing a substantially circular pencil core of improved electrical performance. As shown in FIG. 5A, a continuous strip 21 of electrical steel such as from a roll is fed to a cutting device 22 which may take various forms. The continuous strip 21 has a width 24 equal to or slightly larger than a desired width 26 of the completed pencil core cross-section 25 as shown in dashed lines at 25. Cutting device 22 thus creates a plurality of starting strips 23 each of which are substantially longer than a desired length of the finished pencil core so that many pencil cores can be created from a single starting stack of strips 23.

The continuous strip 21 is preferably provided with a bonding layer 27 at the top and bottom of strip 21 (and possibly even covering the opposite edges). Preferred bonding adhesives to use as a material for the bonding layer are the Rembrandtin Emersol EB 548 as described in the data sheet labeled "TDS EB 548" dated 2008, and the DuPont Voltatex as described in data sheet "Datasheet Voltatex(R)" dated Aug. 30, 2004, both of which are incorporated herein by reference. Preferably the adhesive is applied and dried, and then later heated and cured for bonding after stacking the starting strips described hereafter. This bonding material layer 27 is shown in the side view of FIG. 5B for one of the starting strips 23.

Alternatively, the starting strips 23 may be coated with the bonding adhesive layer 27 after they have been cut into the starting strips.

In either of the above processes, the bonding layer 27 may be provided on one side only.

The continuous strip 21 may be provided by slitting or shearing to the desired width 24 described above.

The length of the starting strips 23, although being a multiple of the final length of the pencil core, is selected to be a length which is manageable for following steps.

Although the bonding material layer 27 is preferably heat cured, other types of bonding material for the bonding layer may be provided where the bonding material or bonding agent is activated via other methods such as ultrasound, UV, pressure, etc.

Figure 5C:
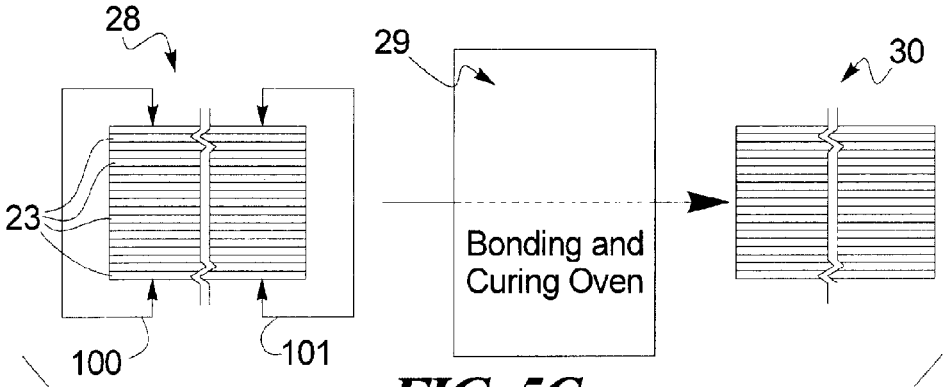

As shown in FIG. 5C, a plurality of the starting strips 23 with the bonding layers 27 thereon are stacked in a stack 28 which is then clamped such as by schematically illustrated clamps 100 and 101 and then introduced into a bonding and curing oven 29 where the bonding material layer is heated and cured. The intimately bonded stack 30 is then removed from the bonding oven 29 with the clamps being removed. Application procedures for the layer 27 and then heating and curing procedures for the bonding are described in the aforementioned data sheets of Rembrandtin Emersol and DuPont.

As shown in FIG. 5D, a perspective view is illustrated showing a substantially square end profile or cross-section with the lamination starting strips 23 tightly bonded to each other. By use of a progressive mechanical machining and cutting at progressive combined machining and cutting station 31, the starting strip stack at 30 having the substantially square end profile or cross-section is progressively machined to a substantially circular end profile or cross-section, and then the progressively machined portions are progressively cut to the desired length to form substantially circular finished pencil cores 32. A narrow flat bottom region 75A and top region 75B may alternately be provided as shown in the alternate embodiment of 32'.

In FIG. 5D, the bonded together stack is progressively machined at the machining and cutting station 31 such as by a screw machine, a lathe, a turning center, or other machines combined with a cutter to create the desired diameter and circular shape (except for the narrow flat regions if provided) of the desired finished pencil core and the machined portions are then progressively cut to form the finished pencil cores of desired length.

As alternatively shown in FIG. 5D', instead of combining the machining and cutting in a single station, a separate machining station 7 may be provided for receiving the bonded strip stack 30 which then outputs a machined bar stock 60 to its separate cutting station 33 which then cuts the bar stock to create the finished cut to length pencil cores 34.

Significantly, unlike the method described in the '365 patent, very surprisingly and unexpectedly, no additional de-burring and/or de-smearing process is required after the machining to create the substantially circular finished pencil cores. This is because the bonding as a result of the heating and curing in the bonding and curing oven so intimately bonds together the adjacent starting strip laminations 23 in such a close and intimate fashion that no smearing or burring occurs during the machining operation. This is one of many significant advantages of the present improved method. Another major advantage is the creation of a relatively long bonded stack for use in creating the final pencil cores. Also electrical performance is better since there are no retaining embossments, no cutouts for channels at the end faces, and no welds at the end faces of the pencil cores, for holding the laminations together.

Figure 6A:
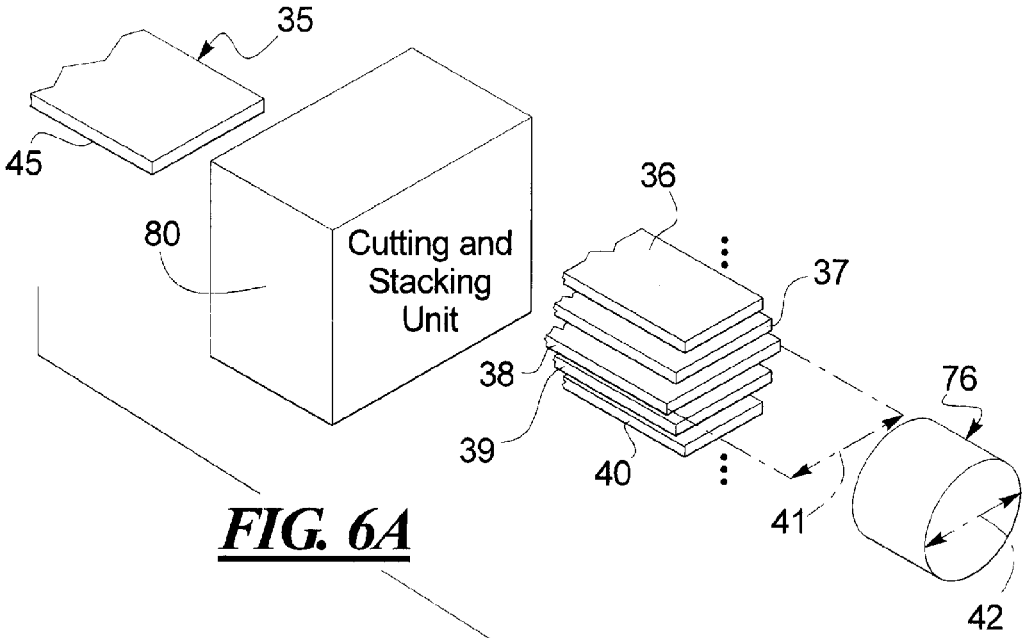

In an alternate embodiment as shown in FIGS. 6A-6D', beginning with the step illustrated in FIG. 6A, a continuous strip 35, having a bonding layer 45 thereon at one or both sides of strip 35 may be fed to a cutting unit 80. The cutting unit 80 may, for example, be a die as shown in the '278 patent to create starting strips 36, 37, 39, 40 of decreasing width above and below one or more central starting strips 38. The central starting strip or strips 38 have a width 41 at least equal to or slightly larger than a desired width 42 of the desired pencil core 76.

Figure 6B:
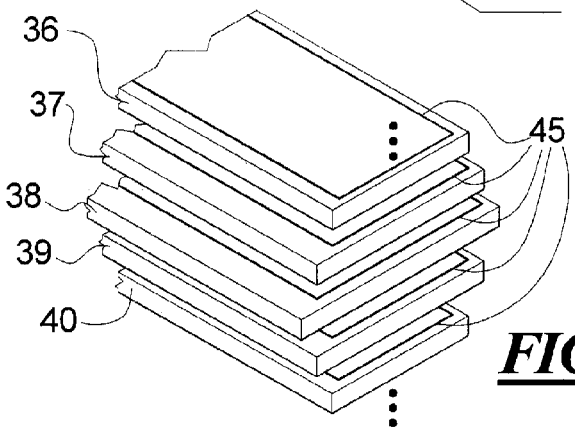

As shown in FIG. 6B, the central and decreasing width strips may already have the bonding layer 45 thereon or the bonding layer 45 may be applied after the cutting.

Figure 6C:
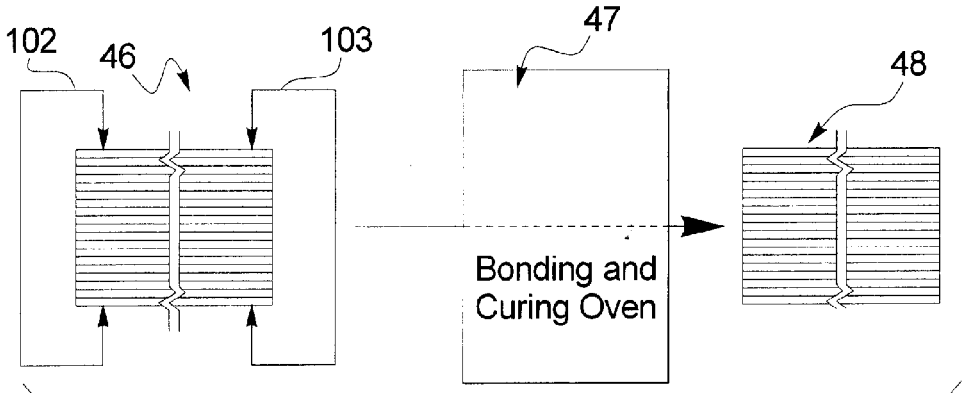

As shown in FIG. 6C, the decreasing width starting strips 36, 37, 39, and 40 above and below central strip 38 are stacked to create a stack 46 having an end profile or cross-section as shown in FIG. 6D in perspective. This stack is clamped such as by schematically illustrated clamps 102 and 103 and is then fed to the bonding and curing oven 47. After bonding and curing, the bonded stack 48 results.

As shown in FIG. 6D, the perspective view illustrates an end profile or cross-section having a plurality of steps 49 at the outer periphery. A progressive combined machining and cutting station 50 progressively machines to eliminate the steps 49 and create a substantially circular end profile or cross-section. The progressively machined portions are then progressively cut to the desired length to form the finished pencil cores 51. Narrow flat bottom and top regions 77A and 77B may be alternately provided in the alternate embodiment of 51'. Thus a substantially circular finished pencil core 51 (or 51') is created after the progressive machining and cutting.

Alternatively, as shown in FIG. 6D', instead of using a combined machining and cutting station, a separate machining station 51 receives the bonded stack 48 and machines it to create a machined bar stock 70 which is then fed to a separate cutting station 52 to create the final finished pencil cores 53 cut to the appropriate length.

As was explained in the embodiment of the method of FIG. 5A-5E', de-burring and/or de-smearing is surprisingly and unexpectedly not required after the machining as indicated in explaining the embodiment of the method of FIGS. 5A-5E'. Also no retaining embossments are required, no cutouts for channels at the end faces, and no welds are required at the end faces of the pencil cores for holding the laminations together.

In summary, the resulting pencil core has a relatively higher electrical performance since it has substantially no steps at a periphery, does not have embossments for holding the laminations together, does not have cutouts for channels at the end faces, and there are no welds at the end faces. Also fewer method steps are required for manufacture. Furthermore, more steel is provided for a given core diameter by elimination of the steps at ends of the laminations. And significantly, because of the intimate bonding, subsequent to machining no de-burring and de-smearing processes are necessary.

While preferred embodiments have been illustrated and described in detail in the drawings and foregoing description, the same are to be considered as illustrative and not restrictive in character, it being understood that only the preferred embodiments have been shown and described and that all changes and modifications that come within the spirit of the invention both now or in the future are desired to be protected.

I claim as my invention:

1. A method for manufacturing pencil cores having a substantially circular cross-section, comprising the steps of:

providing a continuous strip of electrical steel;

cutting the continuous strip to create a plurality of starting strips as laminations each having a length longer than a desired length of the pencil cores being manufactured and having a strip width at least equal to or larger than a desired diameter of said cross-section of the pencil cores being manufactured, said starting strips being provided with a bonding layer either before or after the cutting into the starting strips;

stacking the starting strips into a stack and heating and curing the stack to create a bonded stack;

machining the bonded stack to said substantially circular cross-section; and without a de-burring operation and without a de-smearing operation after said machining, cutting the machined bonded stack to create a plurality of said pencil cores of said desired length without welds at end faces of the pencil cores to hold the laminations together.

2. The method of claim 1 wherein the bonded stack is progressively machined to said substantially circular cross-section and machined portions are progressively cut to form said pencil cores of said desired length, said machining and cutting being performed at a same progressive combined machining and cutting station.

3. The method of claim 1 wherein a separate machining station is used to create the machined bonded stack for forming a bar stock and then the bar stock is cut at a separate cutting station to form said pencil cores of said desired length.

4. The method of claim 1 wherein said starting strips are provided with said bonding layer before the cutting into the starting strips.

5. The method of claim 1 wherein the bonding layer is provided only on one side of the starting strips.

6. The method of claim 1 wherein the bonding layer is provided on both sides of the starting strips.

7. The method of claim 1 wherein the bonding layer is provided on the starting strips after the cutting to create the starting strips.

8. The method of claim 1 wherein no embossments are provided in the laminations of the pencil cores.

9. The method of claim 1 wherein no cutouts to form channels are provided in end faces of the laminations of the pencil cores.

10. The method of claim 1 wherein said bonded stack prior to machining has a substantially square cross-section.

11. The method of claim 1 wherein said bonding layer comprises Rembrandtin Emersol EB 548 or DuPont Voltatex.

12. The method of claim 1 wherein said substantially circular cross-section is entirely circular with no flat regions.

13. A method for manufacturing pencil cores having a substantially circular cross-section, comprising the steps of:

providing a continuous strip of electrical steel;

cutting the continuous strip to create a plurality of starting strips as laminations each having a length longer than a desired length of the pencil core being manufactured, at least one of the starting strips having a strip width at least equal to or larger than a desired diameter of said cross-section of the pencil cores being manufactured and other of said starting strips having strip widths of successively decreasing strip width, said starting strips being provided with a bonding layer either before or after the cutting into the cutting strips;

stacking the starting strips into a stack and heating and curing the stack to create a bonded stack;

machining the bonded stack to said substantially circular cross-section; and without a de-burring operation and without a de-smearing operation after said machining, cutting the machined bonded stack to create a plurality of said pencil cores of said desired length without welds at end faces of the pencil cores to hold the laminations together.

14. The method of claim 13 wherein the bonded stack is progressively machined to said substantially circular cross-section and machined portions are progressively cut to form said pencil cores of said desired length, said machining and cutting being performed at a same progressive combined machining and cutting station.

15. The method of claim 13 wherein a separate machining station is used to create the machined bonded stack for forming a bar stock and then the bar stock is cut at a separate cutting station to form said pencil cores of said desired length.

16. The method of claim 13 wherein said starting strips are provided with said bonding layer before the cutting into the starting strips.

17. The method of claim 13 wherein the bonding layer is provided only one side of the starting strips.

18. The method of claim 13 wherein the bonding layer is provided on both sides of the starting strips.

19. The method of claim 13 wherein the bonding layer is provided on the starting strips after the cutting to create the starting strips.

20. The method of claim 13 wherein no embossments are provided in the laminations of the pencil cores.

21. The method of claim 13 wherein no cutouts to form channels are provided in end faces of the laminations of the pencil cores.

22. The method of claim 13 wherein said bonded stack prior to machining has steps at a periphery thereof.

23. The method of claim 13 wherein said bonding layer comprises Rembrandtin Emerso EB 548 or DuPont Voltatex.

24. The method of claim 13 wherein said substantially circular cross-section is entirely round with no flat regions.

25. A method for manufacturing pencil cores having a substantially circular cross-section, comprising the steps of:

providing a continuous strip of electrical steel;

cutting the continuous strip to create a plurality of starting strips as laminations, at least one of the strips having a strip width at least equal to or larger than a desired diameter of said cross-section of the pencil cores being manufactured, said starting strips being provided with a bonding layer either before or after the cutting into the starting strips;

stacking the starting strips into a stack and heating and curing the stack to create a bonded stack; and machining the bonded stack to said substantially circular cross-section and without a de-burring and without a de-smearing operation after said machining.

26. A method for manufacturing pencil cores having a substantially circular cross-section, comprising the steps of:

providing a continuous strip of electrical steel;

cutting the continuous strip to create a plurality of starting strips as laminations, at least one of the strips having a strip width at least equal to or larger than a desired diameter of said cross-section of the pencil cores being manufactured, said starting strips being provided with a bonding layer either before or after the cutting into the starting strips;

stacking the starting strips into a stack and heating and curing the stack to create a bonded stack;

machining the bonded stack to said substantially circular cross-section and without a de-burring or de-smearing operation after said machining; and each of the starting strips having a length longer than a desired length of the pencil cores being manufactured and performing a progressive machining of the bonded stack, and progressively cutting the progressively machined bonded stack to create a plurality of said pencil cores of said desired length.

* * * * *